US007023394B2

(12) United States Patent
Mahr

(10) Patent No.: US 7,023,394 B2
(45) Date of Patent: Apr. 4, 2006

(54) CASSEGRAIN-TYPE FEED FOR AN ANTENNA

(75) Inventor: Ulrich E Mahr, Backnang (DE)

(73) Assignee: Marconi Communications GmbH, Backnang (DE)

( * ) Notice: Subject to any disclaimer, the term of this patent is extended or adjusted under 35 U.S.C. 154(b) by 0 days.

(21) Appl. No.: 10/451,588

(22) PCT Filed: Dec. 5, 2001

(86) PCT No.: PCT/IB01/02775

§ 371 (c)(1),
(2), (4) Date: Dec. 29, 2003

(87) PCT Pub. No.: WO02/052681

PCT Pub. Date: Jul. 4, 2002

(65) Prior Publication Data

US 2004/0090388 A1 May 13, 2004

(30) Foreign Application Priority Data

Dec. 27, 2000 (EP) ..... 00128563

(51) Int. Cl.
*H01Q 13/00* (2006.01)

(52) U.S. Cl. ..... 343/786; 343/781 P; 343/781 CA

(58) Field of Classification Search ..... 343/786, 343/756, 840, 781 P, 781 CA, 781 R, 785
See application file for complete search history.

(56) References Cited

U.S. PATENT DOCUMENTS

| | | | | |
|---|---|---|---|---|
| 4,295,142 | A | 10/1981 | Thiere et al. | 343/781 CA |
| 4,963,878 | A | 10/1990 | Kildal | 343/781 P |
| 5,122,810 | A * | 6/1992 | Nisbet et al. | 343/756 |
| 5,543,814 | A | 8/1996 | Jenness, Jr. | 343/840 |
| 5,973,652 | A * | 10/1999 | Sanford et al. | 343/781 P |
| 6,020,859 | A | 2/2000 | Kildal | 343/781 CA |

FOREIGN PATENT DOCUMENTS

| | | |
|---|---|---|
| EP | 0 352 976 A2 | 3/1990 |
| EP | 0 439 800 A1 | 12/1990 |

* cited by examiner

*Primary Examiner*—Hoang V. Nguyen
(74) *Attorney, Agent, or Firm*—Kirschstein et al.

(57) ABSTRACT

A cassegrain-type feed for a parabolic antenna is a dual-band feed and employs a waveguide feeding a dielectric cone feeding a subreflector. The waveguide has an end-portion adjacent a narrow end of the cone. The impedance of an inner wall of the cone is modified by the inclusion of a dielectric sleeve of thickness between ⅙ and ¼ of a wavelength relative to propagation in the sleeve at a mean value of the upper of the two frequency bands concerned. The sleeve helps to provide a rotationally substantially symmetric illumination of the subreflector in the upper frequency band and, when used with a parabolic main reflector, a similarly symmetric illumination of the main reflector also. The sleeve may be replaced by a series of grooves formed in the inner wall of the waveguide end-portion, these grooves being nominally ¼ of a mean wavelength deep.

18 Claims, 3 Drawing Sheets

CASSEGRAIN-TYPE FEED FOR AN ANTENNA

This application is a 371 of PCT/IB01/02775 dated Dec. 5, 2001.

The invention relates to a Cassegrain-type feed for an antenna, in particular, but not exclusively, a Cassegrain-type feed for a parabolic antenna.

It is known for parabolic antennas to be fed from a so-called Cassegrain feed arrangement. Such an arrangement is illustrated in FIG. 1, in which the various components are to be understood as being rotationally symmetric about the z-axis, and comprises the reflecting antenna 10 and, projecting through the centre thereof and along the z-axis, the feed arrangement 12. The feed arrangement is shown in greater detail in FIG. 2 and is made up of a waveguide section 20, which at one end 21 passes through the centre of the antenna 10 (not shown in FIG. 2) and at the other end 22 adjoins the small-diameter end of a dielectric cone 23. The larger-diameter end of the cone 23 adjoins a subreflector 24 which serves to reflect radiation incident thereon from the waveguide section toward the antenna 10 (transmit mode) or from the antenna 10 to the waveguide section (receive mode), via the cone 23. The function of the cone is described in "Dielguides—highly efficient Low-Noise Antenna Feeds" by H. E. Bartlett and R. E. Moseley, Microwave Journal, vol. 9, December 1966, pp 53–58. To improve matching in the air-cone interface the cone is often provided with corrugations 25. Further, to minimise return loss a dielectric multistage step transformer 26 is included, which may be made from the same dielectric material as the cone and formed integrally therewith, as shown, and the subreflector 24 may include a tuning disk 27 at its central portion, again to reduce the return loss.

The feed arrangement just described is a single-band device for feeding radiation at a mean frequency of, e.g., 3.9 GHz. Also known, however, are feeds for dual-band operation, the advantage of these being that the need for two separate feed arrangements for the individual bands is obviated, the result being a saving in cost and complexity. An example of a known dual-band feed arrangement is illustrated in FIG. 3. In FIG. 3*a* a waveguide section 30 feeds a metallic cone element 31 which propagates microwave energy toward a subreflector 32, the subreflector being secured and positioned with respect to the feed elements 30, 31 by means of stays 33. The conical part 34 of the cone element 31 is conventionally supplied with grooves 35 (see FIG. 3*b*). In practice, in order to facilitate operation in the two frequency bands concerned, the grooves are made to alternate between two depths 36 and 37 (see FIG. 3*c*).

The known dual-band device of FIG. 3 has the drawbacks of complexity, bulk and high cost.

Discussions on dielectric feeds are contained in, among other sources: "Dielektrische Erreger für Richtfunk-Parabolantennen, Diskussionssitzung des Fachausschusses Antennen der ITG", Lindau i. Bodensee, 12–13 Oct. 1988, pp 48–50; "Design and Analysis of arbitrarily shaped Dielectric Antennas", by B. Toland, C. C. Liu and P. G. Ingerson, Microwave Journal, May 1997, pp 278–286; "Dielectric-Lined Waveguide Feed" by Akhileshwar Kumar, IEEE Transactions on Antennas and Propagation, vol. AP-27, No. 2, March 1979, and "Aperture Efficiency Enhancement in Dielectrically Loaded Horns" by G. N. Tsandoulas and W. D. Fitzgerald, IEEE Transactions on Antennas and Propagation, vol. AP-20, No. 1, January 1972. Non-dielectric horn antennas which achieve high sidelobe suppression and beamwidth equalisation are disclosed in: "A New Horn Antenna with Suppressed Sidelobes and Equal Beamwidths" by P. D. Potter, Microwave Journal, vol. VI, pp 71–78, June 1963 and U.S. Pat. No. 3,413,641 ("Dual-Mode Antenna"—R. H. Turin).

In accordance with a first aspect of the invention there is provided a Cassegrain-type feed for an antenna, comprising: a waveguide section having an end-portion, the waveguide section having internal dimensions which support the propagation of a fundamental quasi-TE11 mode in lower and upper frequency bands: a dielectric cone having a small-diameter end and a large-diameter end, the small-diameter end adjoining said waveguide end-portion; a subreflector adjoining the large-diameter end of the cone; and a multi-stage step transformer attached to the small-diameter end of the dielectric cone for matching the impedance of the cone to the waveguide section, the feed being characterised in that the it is a dual-band feed covering the lower and upper frequency bands and the waveguide end-portion is provided at an inner wall thereof with a wall-impedance changing means for changing the impedance of the inner wall to couple a quasi-TM11 mode in the upper frequency band and to thereby achieve a rotationally substantially symmatric illumination of the subreflector in the upper frequency band.

Advantageously the wall-impedance changing means further stimulates excitation of a quasi-TE12 mode in the upper frequency band.

In one embodiment the wall-impedance changing means comprises grooves formed in the inner wall of the waveguide section. Preferably, the grooves have a depth of approximately one-quarter of a mean wavelength of the upper frequency band, referred to propagation in the waveguide section.

In a preferred embodiment the wall-impedance changing means comprises a dielectric sleeve received in the waveguide end-portion. Preferably, the dielectric sleeve has a thickness of between approximately one-quarter and approximately one-sixth of a mean wavelength of the upper frequency band, referred to propagation in the sleeve. Advantageously, the dielectric sleeve has a length which is greater than one wavelength at the highest frequency of the upper frequency band. Preferably it has a length which is approximately two wavelengths. Preferably the sleeve is formed as an integral part of the dielectric cone.

The waveguide section can be of substantially uniform diameter throughout its length. Alternatively, the waveguide end-portion is of greater diameter than that of the rest of the waveguide section, such that a recess having a shoulder is formed, allowing a correct seating of the sleeve in the waveguide section to be established.

Advantageously, the transformer is formed as an integral part of the dielectric cone.

Preferably, a final stage of the transformer located at an aperture of said waveguide end-portion has a diameter which is approximately 75% of that of the waveguide end-portion.

Advantageously, the dielectric cone has on its outer flared surface a series of corrugations. Such corrugations improve matching at the air-cone interface.

Preferably, the subreflector has at a central potion thereof a disk for the reduction of return loss in signals incident upon the subreflector.

According to a second aspect of the invention there is provided a parabolic antenna arrangement comprising: a parabolic reflector and, passing through a central portion of said parabolic reflector, a Cassegrain-type feed in accordance with the first aspect of the invention.

An embodiment of the invention will now be described, by way of example only, with reference to the drawings, of which:

Figure 2:
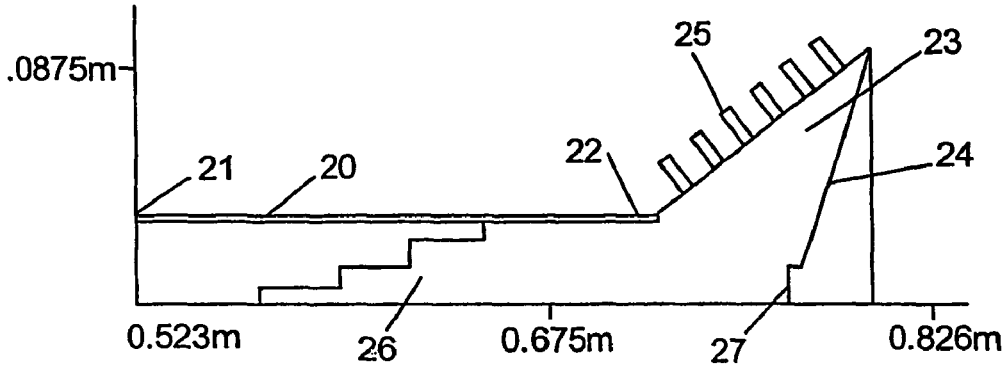
FIG. 2 is a more detailed representation of the feed shown in FIG. 1.
Figure 4:
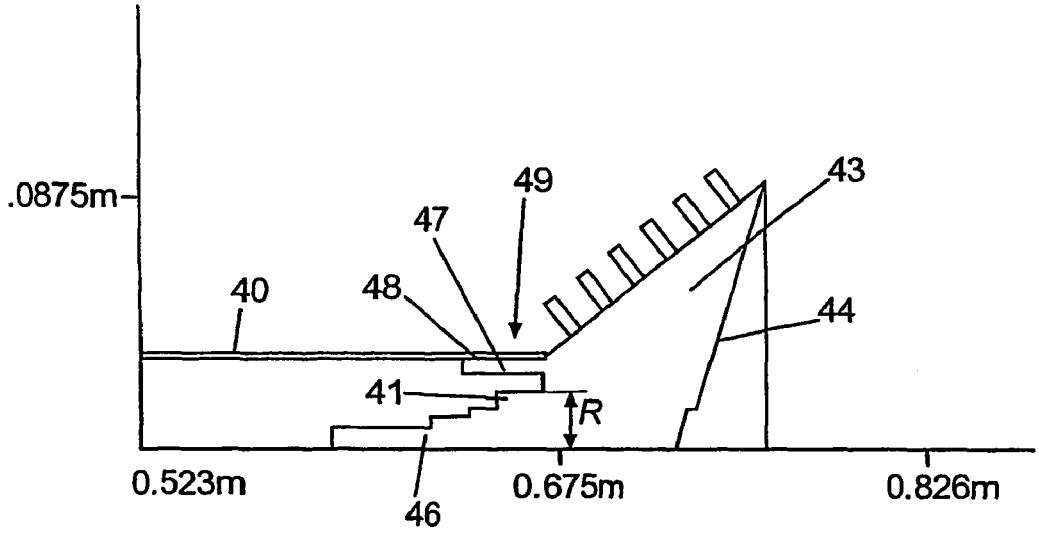
FIG. 4 is a Cassegrain-type feed in accordance with an embodiment of the present invention.

Referring now to FIG. 4, an embodiment of the present invention employs a waveguide section 40, a dielectric cone 43, a subreflector 44 and a dielectric transformer 46 corresponding to the equivalent items in FIG. 2, but provides in addition an impedance-changing means 47 for changing an impedance of the inner wall 48 of the waveguide section 40 at an end-portion 49 thereof. The impedance-changing means 47 is a dielectric sleeve which, in the embodiment shown, is a protrusion (hollow cylinder) formed in the cone 43; thus the sleeve is an integral part of the cone. It may alternatively be a separate component, though there may then be difficulties experienced in providing adequate seating for the cone itself. The sleeve has a thickness of between one-quarter and one-sixth the wavelength (in the dielectric) corresponding to the mean upper-band frequency. As in FIG. 2, the dielectric transformer 46 in FIG. 4 is advantageously made from one and the same dielectric material as the cone and is integral therewith. As an example, the dielectric used in a test embodiment of the invention had a dielectric constant $\epsilon$=2.56, though other constants are equally possible.

Figure 6:
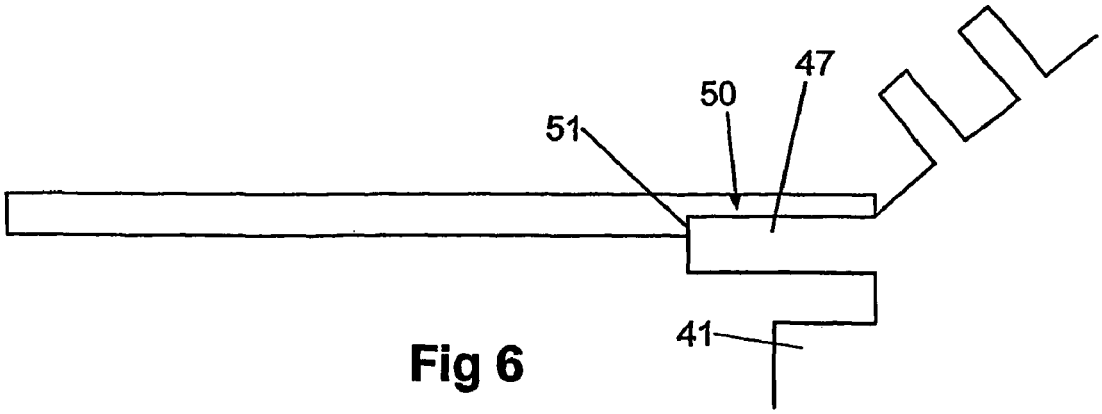
FIG. 6 is a partial view of the feed of FIG. 4 showing a modification thereof.

The effect of the dielectric sleeve 47 is to change the wall impedance, so that the quasi-TM11 mode is coupled to with proper amplitude and phase. In addition the sleeve serves as a mechanical fixture between the cone and the waveguide. This is particularly the case where an arrangement such as that shown in FIG. 6 is employed, in which a recess 50 and associated shoulder 51 are used to accommodate the sleeve. In this case the position of the cone and transformer is secured both radially and axially in the waveguide.

The length of the dielectric sleeve should be greater than one wavelength in the partially filled waveguide at the highest frequency of interest in the upperband. In the example shown the length is approximately two wavelengths.

A further difference between the known arrangement of FIG. 2 and the embodiment of the invention shown in FIG. 4 is the decreased length of the pat of the waveguide section 40 which is completely filled with dielectric, this allowing the excited TM11 mode to reach the dielectric cone 43 with low dispersion. This length should be as short as possible in order to minimise dispersion and in the illustrated embodiment is actually zero. The various stages of the transformer are empirically dimensioned in a manner known in the art, e.g. by using $\lambda/4$ stages as a point, such as to result in minimum return loss.

In a test antenna arrangement incorporating the above-described dualband feed, the antenna was a parabola 3 m in diameter (subtended angle 180°), the total length of the waveguide feed was 675 mm and the radius R (see FIG. 4) of the final stage 41 of the step transformer was approximately 75% of that of the inner diameter of the sleeve 47. Further parameters, specified with reference to FIG. 5*a*, had the values listed in the following table:

TABLE 1

| Parameter | Doubleband | Singleband 3.9 GHz | Singleband 6.7 GHz |
|---|---|---|---|
| d(mm) | 65 | 54 | 31.30 |
| Ds(mm) | 203.84 | 184.4 | 110.49 |
| $\theta_1$(deg.) | 38 | 36 | 36 |
| $\theta_2$(deg.) | 20 | 17 | 17 |

Figure 3A:
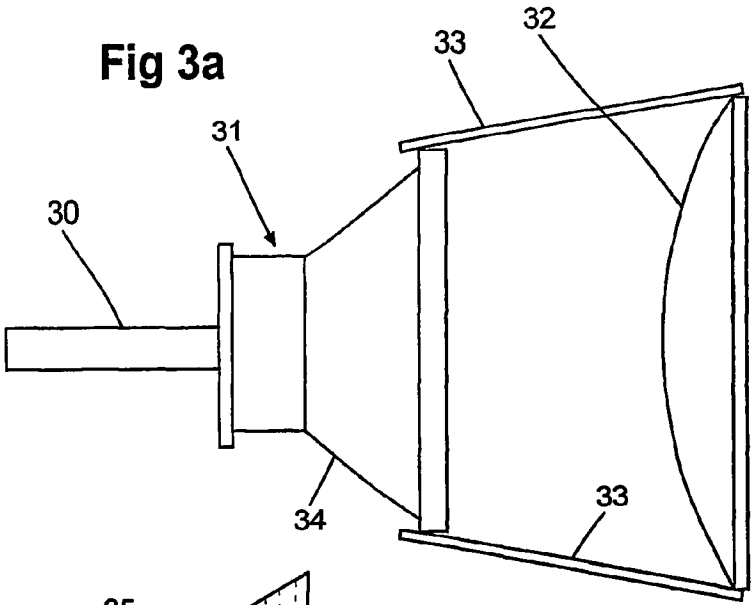
FIG. 3 is a known dual-band Cassegrain-type feed.
Figure 3B:
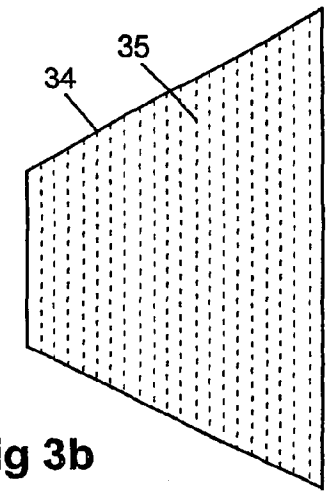

The value of 65 mm for the doubleband waveguide diameter d arose primarily from the need to be able to match the waveguide to the dual-band orthomode transducer used for the more conventional doubleband arrangement of FIG. 3*a* the transition piece for which was 65 mm in diameter. At all events the value of d will depend on the position of the two frequency bands relative to each other. Above 4.5 GHz in the present example there is a strong degradation of the radiation pattern and, where d is increased to, for example, 71 mm, this degradation takes hold in the lower band at around 4.2 GHz, which is clearly undesirable. At the other extreme 54 mm is, in the given example, too small, unless a suitably large step increase in diameter (of the recess shown in FIG. 6) is employed. The optimum diameter can be determined by empirical means (e.g. computer simulation) and then, where necessary, be deviated from slightly in order, as in this case, to accommodate the dimensions of a waveguide component (here the transition piece), which may have to be used.

Figure 5A:
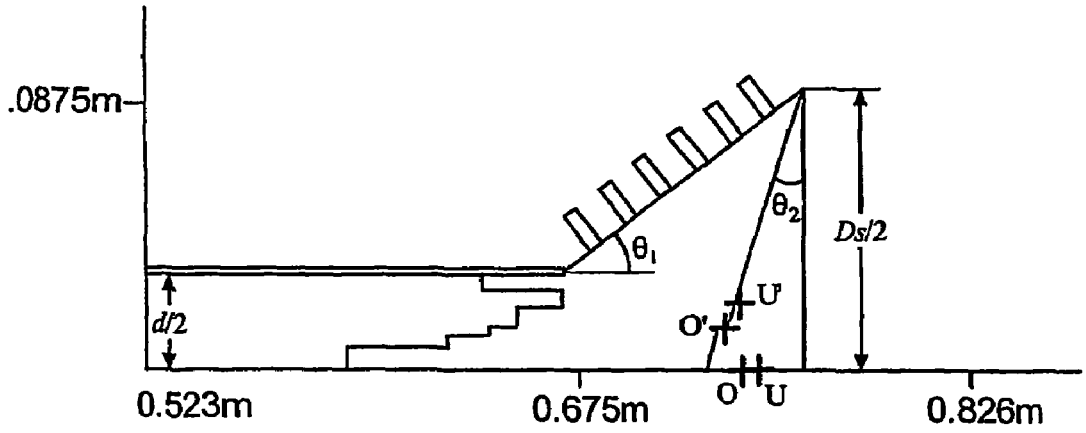
FIG. 5*a* is the feed of FIG. 4 with various parameters, including phase centres, included.
Figure 5B:
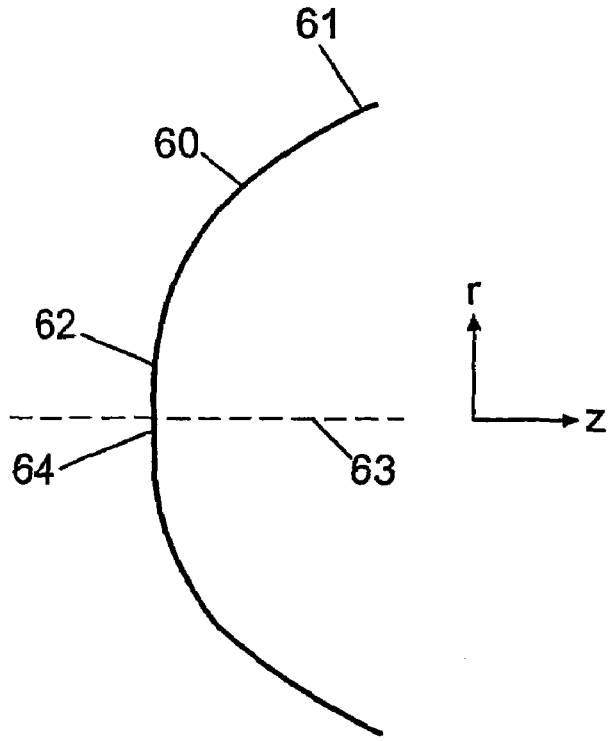
FIG. 5*b* depicts a sectional view of an offset or "ring" parabola which may be employed in an embodiment of the present invention.

FIG. 5*a* also shows the positions of the phase centres for the described embodiment, both for the lowerband ("U") and for the upperband ("O"). As can be seen, the phase centres do not coincide, so that, strictly speaking, a waveguide of different lengths would be required for optimal performance in the two bands concerned (tests reveal these optimal lengths to be approximately 662 mm at 3.6 GHz and 684 mm at 6.775 GHz). However, it is found that, for a compromise waveguide length of around 675 mm, the efficiencies for the two bands are very acceptable and lie, in fact, at over 64% taking into account also suitable matching via the subreflector disk 27 and the dielectric transformer 26. Such matching is carried out empirically, e.g. with the aid of computer simulation. Two more phase centres ("O'" and "U'") are illustrated, which are the optimum penetration points of the focal ring of a rotationally symmetric offset parabola (a "ring" parabola). Such an antenna is shown in section in FIG. 5*b*, in which a parabola 60, having ends 61, 62, is assumed to be rotated 360 about the z-axis 63. The figure thus formed has a central aperture which is filled with a plane disk 64.

While mention has been made so far only to the encouragement of the quasi-TM11 mode in the upperband, in order to achieve the desired enhanced rotationally symmetric illumination of the subreflector (and hence also of the main reflector), in practice in the test arrangement just described a fairly strong stimulation of the quasi-TE12 mode also occurred, which also contributed to the desired effect. However, this other mode was significantly less of a contributory factor than the quasi-TM11 mode.

As already mentioned, in a variant of the embodiment illustrated in FIG. 4 (see FIG. 6), the dielectric sleeve 47 is received in a recess 50 in the waveguide wall. The recess has a shoulder 51 which may be arranged to act as a stop for the insertion of the sleeve 47, there being provided thereby a more repeatable seating of the sleeve in the waveguide with consequently greater consistency of performance from feed to feed. Again, in this variant realisation, the final stage 41 of the step transformer will ideally have a diameter approximately 75% of the inner diameter of the sleeve 47.

Figure 3C:
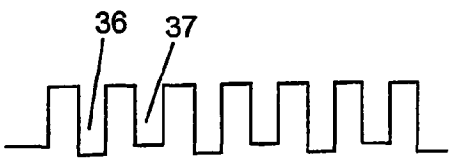
Figure 1:
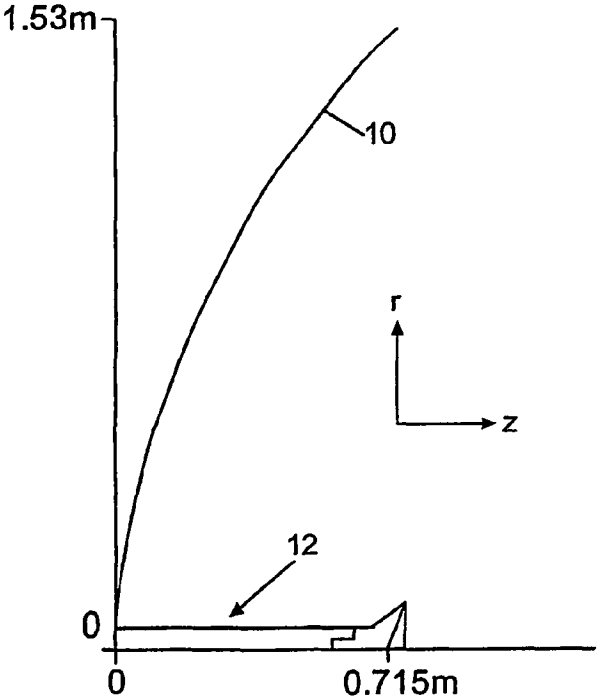
FIG. 1 is an antenna arrangement incorporating a known single-band Cassegrain-type feed.

In a further embodiment of the feed arrangement, the inner wall of the end-portion 49 (see FIG. 4) of the waveguide section is provided with grooves instead of a dielectric lining. The depth of the grooves is nominally $\lambda/4$ ($\lambda$ is wavelength in the material which fills the grooves) and the axial dimension of the grooves should be small in comparison with the shortest wavelength to be used. The depth of the grooves would not have to alternate, in the manner of FIG. 3*c*, since they are only required to have an effect in one of the two bands—the upper band.

Although the invention has hitherto been described in connection with a parabolic antenna, it is also suitable for use with other antenna shapes, e.g. a spherical antenna.

The invention claimed is:

1. A cassegrain-type feed for an antenna, comprising:

a) a waveguide section having an end-portion, the waveguide section having internal dimensions which support a propagation of a fundamental quasi-TE 11 mode in lower and upper frequency bands;

b) a dielectric cone having a small-diameter end and a large-diameter end, the small-diameter end adjoining the waveguide end-portion;

c) a subreflector adjoining the large-diameter end of the cone;

d) a multi-stage step transformer attached to the small-diameter end of the cone for matching an impedance of the cone to the waveguide section;

e) the feed being a dual-band feed covering the lower and upper frequency bands; and f) the waveguide end-portion being provided at an inner wall thereof with a wall-impedance changing means comprising grooves formed in the inner wall of the waveguide section, and operative for changing an impedance of the inner wall to couple the quasi-TM 11 mode in the upper frequency band, to thereby achieve a rotationally substantially symmetric illumination of the subreflector in the upper frequency band.

2. The feed as claimed in claim 1, wherein the grooves have a depth of approximately one-quarter of a mean wavelength of the upper frequency band, referred to propagation in the waveguide section.

3. The feed as claimed in claim 1, wherein the waveguide section is of substantially uniform diameter throughout its length.

4. The feed as claimed in claim 1, wherein a final stage of the dielectric transformer located at an aperture of the waveguide end-portion has a diameter which is approximately 75% of that of the waveguide end-portion.

5. The feed as claimed in claim 1, wherein the subreflector has a central portion, and a disk at the central portion for reducing return loss in signals incident upon the subreflector.

6. A cassegrain-type feed for an antenna, comprising:

a) a waveguide section having an end-portion, the waveguide section having internal dimensions which support a propagation of a fundamental quasi-TE 11 mode in lower and upper frequency bands;

b) a dielectric cone having a small-diameter end and a large-diameter end, the small-diameter end adjoining the waveguide end-portion;

c) a subreflector adjoining the large-diameter end of the cone;

d) a multi-stage step transformer formed as an integral part of the cone at the small-diameter end of the cone for matching an impedance of the cone to the waveguide section;

e) the feed being a dual-band feed covering the lower and upper frequency bands; and f) the waveguide end-portion being provided at an inner wall thereof with a wall-impedance changing means for changing an impedance of the inner wall to couple the quasi-TM 11 mode in the upper frequency band, to thereby achieve a rotationally substantially symmetric illumination of the subreflector in the upper frequency band.

7. A cassegrain-type feed for an antenna, comprising:

a) a waveguide section having an end-portion, the waveguide section having internal dimensions which support a propagation of a fundamental quasi-TE 11 mode in lower and upper frequency bands;

b) a dielectric cone having an outer flared surface, a small-diameter end and a large-diameter end, the small-diameter end adjoining the waveguide end-portion, the outer flared surface having a series of corrugations;

c) a subreflector adjoining the large-diameter end of the cone;

d) a multi-stage step transformer attached to the small-diameter end of the cone for matching an impedance of the cone to the waveguide section;

e) the feed being a dual-band feed covering the lower and upper frequency bands; and f) the waveguide end-portion being provided at an inner wall thereof with a wall-impedance changing means for changing an impedance of the inner wall to couple the quasi-TM 11 mode in the upper frequency band, to thereby achieve a rotationally substantially symmetric illumination of the subreflector in the upper frequency band.

8. A cassegrain-type feed for an antenna, comprising:

a) a waveguide section having an end-portion, the waveguide section having internal dimensions which support a propagation of a fundamental quasi-TE 11 mode in lower and upper frequency bands;

b) a dielectric cone having a small-diameter end and a large-diameter end, the small-diameter end adjoining the waveguide end-portion;

c) a subreflector adjoining the large-diameter end of the cone;

d) a dielectric multi-stage step transformer attached to the small-diameter end of the cone for matching an impedance of the cone to the waveguide section;

e) the feed being a dual-band feed covering the lower and upper frequency bands; and f) the waveguide end-portion being provided at an inner wall thereof with a wall-impedance changing means comprising a dielectric sleeve received in the waveguide end-portion, for changing an impedance of the inner wall to couple the quasi-TM 11 mode in the upper frequency band, to thereby achieve a rotationally substantially symmetric illumination of the subreflector in the upper frequency band.

9. The feed as claimed in claim 8, wherein the dielectric sleeve is hollow and is further operative for stimulating excitation of a quasi-TE 12 mode in the upper frequency band.

10. The feed as claimed in claim 8, wherein the dielectric sleeve has a thickness of between approximately one-quarter and approximately one-sixth of a mean wavelength of the upper frequency band, referred to propagation in the sleeve.

11. The feed as claimed in claim 8, wherein the dielectric sleeve has a length which is greater than one wavelength in the partially filled waveguide at the highest frequency of the upper frequency band.

12. The feed as claimed in claim 8, wherein the dielectric sleeve is formed as an integral, hollow cylindrical part of the dielectric cone.

13. The feed as claimed in claim 8, wherein the waveguide section is of substantially uniform diameter throughout its length.

14. The feed as claimed in claim 8, wherein the waveguide end-portion is of greater diameter than that of the rest of the waveguide section, such that a recess having a shoulder is formed, allowing a correct seating of the dielectric sleeve in the waveguide section to be established.

15. The feed as claimed in claim 8, wherein a final stage of the dielectric transformer located at an aperture of the waveguide end-portion has a diameter which is approximately 75% of that of the waveguide end-portion.

16. The feed as claimed in claim 8, wherein the subreflector has a central portion, and a disk at the central portion for reducing return loss in signals incident upon the subreflector.

17. The feed as claimed in claim 8, wherein the wall-impedance changing means is operative for stimulating excitation of a quasi-TE 12 mode in the upper frequency band.

18. A parabolic antenna arrangement, comprising:

A) a parabolic reflector having a central portion, and

B) a cassegrain-type feed passing through the central portion, the feed including:

a) a waveguide section having an end-portion, the waveguide section having internal dimensions which support a propagation of a fundamental quasi-TE 11 mode in lower and upper frequency bands;

b) a dielectric cone having a small-diameter end and a large-diameter end, the small-diameter end adjoining the waveguide end-portion;

c) a subreflector adjoining the large-diameter end of the cone;

d) a dielectric multi-stage step transformer attached to the small-diameter end of the cone for matching an impedance of the cone to the waveguide section;

e) the feed being a dual-band feed covering the lower and upper frequency bands; and f) the waveguide end-portion being provided at an inner wall thereof with a wall-impedance changing means comprising a dielectric sleeve received in the waveguide end-portion, for changing an impedance of the inner wall to couple the quasi-TM 11 mode in the upper frequency band, to thereby achieve a rotationally substantially symmetric illumination of the subreflector in the upper frequency band.

* * * * *

UNITED STATES PATENT AND TRADEMARK OFFICE

CERTIFICATE OF CORRECTION

PATENT NO. : 7,023,394 B2
APPLICATION NO. : 10/451588
DATED : April 4, 2006
INVENTOR(S) : Mahr It is certified that error appears in the above-identified patent and that said Letters Patent is hereby corrected as shown below:

In Column 1, Line 10, delete “Cassegrain” and insert -- Cassegrain-type --, therefor.

In Column 2, Line 22, delete “symmatric” and insert -- symmetric --, therefor.

In Column 2, Line 60, delete “potion” and insert -- portion --, therefor.

In Column 3, Line 55, delete “pat” and insert -- part --, therefor.

In Column 3, Line 62, delete “a point,” and insert -- a starting point, --, therefor.

Signed and Sealed this

Tenth Day of March, 2009

JOHN DOLL
*Acting Director of the United States Patent and Trademark Office*